US005367897A

United States Patent [19]

Hume

[11] Patent Number: 5,367,897

[45] **Date of Patent: * Nov. 29, 1994**

[54] APPARATUS FOR FORMING A PIPE FROM A SHEET METAL PLATE

[76] Inventor: Kenneth M. Hume, 33 Trawalla Avenue, Thomastown. Victoria 3074, Australia

[ * ] Notice: The portion of the term of this patent subsequent to Sep. 21, 2010 has been disclaimed.

[21] Appl. No.: 65,941

[22] Filed: May 21, 1993

Related U.S. Application Data

[63] Continuation of Ser. No. 768,398, Sep. 13, 1991, Pat. No. 5,245,849.

[30] Foreign Application Priority Data

Mar. 15, 1989 [AU] Australia ..... PJ3227
Jul. 12, 1989 [AU] Australia ..... PJ5218

[51] Int. Cl.[5] ..... B21D 5/00; B21D 51/10
[52] U.S. Cl. ..... 72/155; 72/149
[58] Field of Search ..... 72/155, 154, 149, 133, 72/166, 248, 252.5

[56] References Cited

U.S. PATENT DOCUMENTS

| | | | |
|---|---|---|---|
| 289,910 | 12/1883 | Grunder | 29/125 |
| 2,062,591 | 12/1936 | Mather | 72/149 |
| 2,988,127 | 6/1961 | Gray | 72/155 |
| 3,008,220 | 11/1961 | Sammarco | 29/125 |
| 3,062,266 | 11/1962 | Abbott | 72/155 |
| 3,351,001 | 11/1967 | Achkio | 29/125 |

FOREIGN PATENT DOCUMENTS

| | | | |
|---|---|---|---|
| 44311 | 12/1985 | Australia . | |
| 1096821 | 6/1955 | France | 72/149 |
| 2133016 | 1/1972 | Germany . | |
| 742864 | 1/1956 | United Kingdom | 72/149 |
| 725745 | 5/1978 | U.S.S.R. | 72/133 |

*Primary Examiner*—Daniel C. Crane
*Attorney, Agent, or Firm*—Baker & Daniels

[57] ABSTRACT

A plate rolling apparatus, for rolling a plate to form a pipe which may be tapered, a gripper rib (14) on the mandrel (11) for receiving the edge of a flat plate. The mandrel (11) being mounted between support frame ends (24, 25) and on a single pressure roller (15) mounted beneath the mandrel (11) and adapted to contact the surface of the plate and apply a squeezing force against the plate and mandrel (11) during a rolling operation, the pressure roll (15) being laterally movable relative to the center-line of the mandrel depending upon the location of the gripper rib (14) in the region of the roller (15) so as not to foul the gripper rib (14) yet applying said squeezing force to said plate as required. A mandrel (11) having an adjustable taper angle is disclosed as an adjustable mandrel support member (2, 25) and mandrel journal (26) to accommodate variable mandrel diameters and angles of taper.

12 Claims, 6 Drawing Sheets

APPARATUS FOR FORMING A PIPE FROM A SHEET METAL PLATE

This a continuation of application Ser. No. 07/768,398, filed Sep. 13, 1991, now U.S. Pat. No. 5,245,849, issued Sep. 21, 1993.

This invention relates to plate rolling and particularly to method and apparatus for rolling steel plate of small diameter. The invention also relates to the formation of uniform tapered pipe sections suitable for various applications e.g. for use as a pole having street lighting applications.

The inventor has devised apparatus and methods for plate bending and forming pipes of cylindrical construction such as those disclosed in U.S. Pat. No. 3,879,994 to the same inventor and European Patent Specification No. 0029345. In my U.S. Patent Specification there is disclosed a method of plate rolling to form substantially cylindrical pipes simply by bending a plate about a rotatable mandrel.

Steel plate is rolled by engaging an edge of a plate under a flange of a gripper rib extending axially along the cylindrical surface of the mandrel. The mandrel is turned to advance and curve the plate about the surface of the mandrel.

Complete pipes may be formed by this method by curving plate about the mandrel through approximately 180° then engaging the opposite edge of the plate with the mandrel and curving the remaining 180° to form a complete cylinder.

The present invention is specifically concerned with the production of tapered pipes that can be formed on a tapered mandrel having a gripper somewhat similar to that described in my earlier patent. It has been found to be possible to simply form a tapered mandrel and to then curve the plate about the mandrel resulting in the formation of a tapered pipe, however there are difficulties with providing differing tapers and differing pipe thicknesses with any given mandrel.

The present invention in one aspect seeks to provide a method and apparatus to produce a rolled pipe particularly pipes having differing tapers, thicknesses and diameter, ranges on the same mandrel.

A further objective of the present invention is to provide pipe rolling apparatus of the type in which steel plate is drawn on to a mandrel having a gripper for gripping the edge of the plate and including improved means for applying pressure to the plate during the rolling operation irrespective of the location of the gripper.

A more specific object of the invention is to provide a mandrel allowing the formation of a tapered or frusto conical pipe, the mandrel taper and diameter being variable to form a variable range of pipe sizes and taper angles.

There is provided according to the present invention a plate rolling apparatus comprising a rotatable mandrel mounted in a frame, a gripper rib on the mandrel extending axially therealong adapted to grip the edge of a plate to curve around the mandrel when the mandrel is rotated, a single pressure roller mounted beneath the mandrel and adapted to contact the surface of the plate and apply an upward force against the plate and the mandrel, the pressure roll being laterally movable so as not to foul the gripper during plate engagement and yet apply a substantial squeezing force to said plate.

Said single pressure roller is mounted beneath the mandrel and adapted to contact the surface of the plate and apply an upward force against the plate, the pressure roll being laterally movable so as not to foul the gripper during engagement of the plate, and yet apply a substantial squeezing force to said plate and mandrel particularly during the final stage of forming.

The single roller applies pressure to said plate thereby avoiding undesirable lateral forces and is adjustable to be in direct alignment with the mandrel centre when the gripper is not in the vicinity.

The single pressure roller is particularly adaptable for use with the manufacture of small, thick wall pipes requiring high forces, e.g. , tapered pipes suitable for use as power poles.

The present invention is more specifically described having reference to the production of tapered poles, however, in its broadest form it is applicable to parallel wall pipes.

In a more specific aspect of the invention, there is provided a mandrel suitable for the formation of hollow tapered pipe or frusto conical pipe in a simple and effective manner.

There is provided according to the present invention a mandrel suitable for the formation of hollow tapered pipe, said mandrel including a series of disc like laminations mounted in serial formation, each lamination having a diameter slightly less than an adjacent one on one side and a diameter slightly larger than one on the other side so that the formation of laminations taken together form a substantially frusto conical or conical body, a frame work upon which said laminations are mounted so that relative movement of the laminations and the frame work is resisted, said mandrel including a gripper bar for engaging an edge portion of a plate section, said mandrel being adapted to form the plate into a tapered curved section upon rotation of the mandrel and to ultimately form a tapered pipe after curving both opposite edge portions of said plate.

Conveniently, the disc like laminations are non-rotatably mounted upon a shaft which extends for the full length of said mandrel and said laminations are spaced apart a predetermined distance from one another so as to form a desired taper angle. The spacing distance between said laminations may be varied according to the invention so as to vary the angle of the taper of the frusto conical cone thus formed.

Conveniently, the laminations are spaced apart by at least one spacer bar connected to some or each of the laminations. The spacer bar may be utilized to mount the gripper plate so as to form a plate curving mandrel wherein the gripper plate is adapted to engage the edge of a flat plate for ultimate curving about the mandrel.

In a further aspect of the invention upper roller means are located adjacent an upper surface of the mandrel which also press on the metal plate on the mandrel at least at certain stages of the plate bending process.

The upper roller means are supported from a machine frame part which comprise a beam member extending longitudinally and above the mandrel. The mandrel also includes appropriate bearing means to enable the mandrel to be rotated during a bending operation.

This aspect of the machinery has been fully described in my earlier patents referred to previously and is hereby incorporated herein by reference.

A further objective of the present invention is to provide apparatus of the aforementioned type that will enable the tubular member at differing diameters and respective taper angles to be produced from the same machine.

Accordingly, the present invention provides in one preferred arrangement a machine comprising frame means having a base section, upstanding opposed end sections and an upper movable support member, said upstanding opposed end sections including journal means to journal opposed ends of a tapered mandrel, at least one of said journal means being movable in an upward or downward direction, lower roller means mounted from said base section have a plate engagement zone parallel to an adjacent lower surface of said tapered mandrel and adapted to apply pressure to metal plate interposed between said mandrel and said roller means, mounted from said movable support member having a plate engagement zone parallel to an adjacent upper surface of said mandrel, said machine being characterised by means for moving said support member in response to movement of the journal means (or vice versa) whereby the support member end adjacent said movable journal means is moved upwardly or downwardly by a distance being twice that of the movement of the movable journal means.

Conveniently, both ends of the mandrel are movable within proportion with movement of the ends of the support member as aforesaid. In this way, varied diameters and angles of taper of mandrels can be accommodated in the same machine without the need to laboriously adjust plate engaging rollers and the like for different mandrels. It will of course be appreciated that the production of cylindrical tubular members are possible with this machine with an appropriately shaped mandrel.

The present invention will be described in greater detail with reference to the accompanying drawings in which.

Figure 8A:
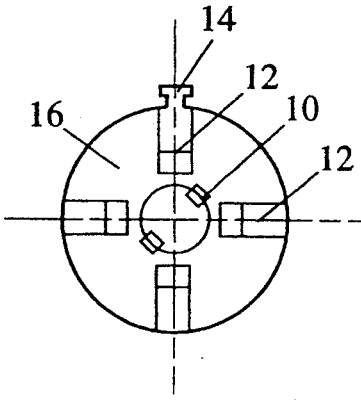
Figure 8B:
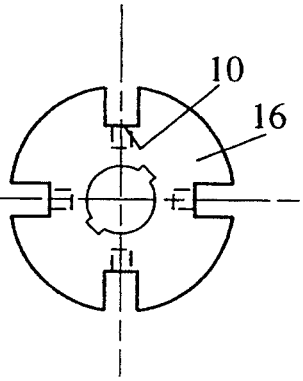
Figure 8C:
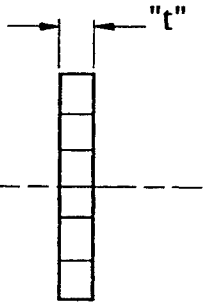
Figure 9:
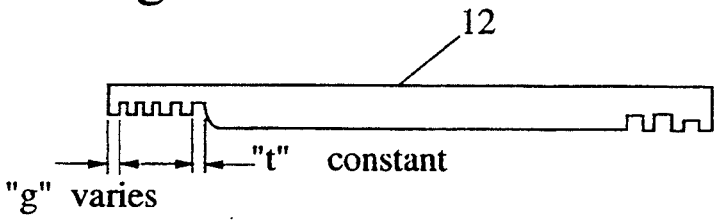
Figure 10:
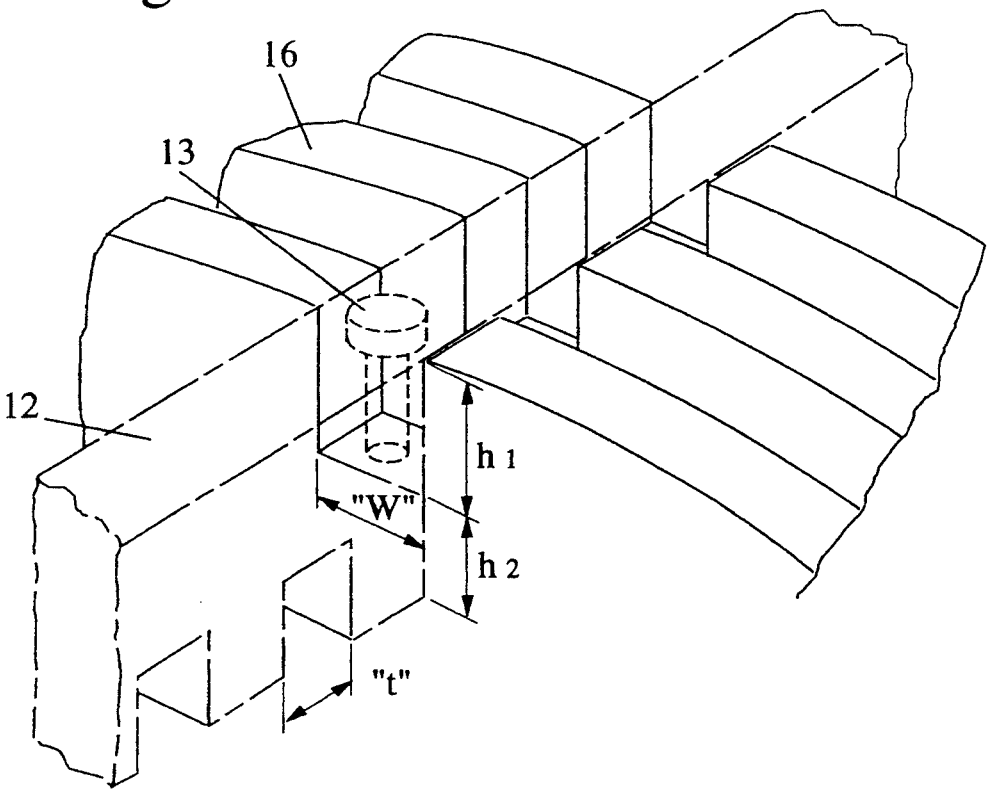
Figure 11:
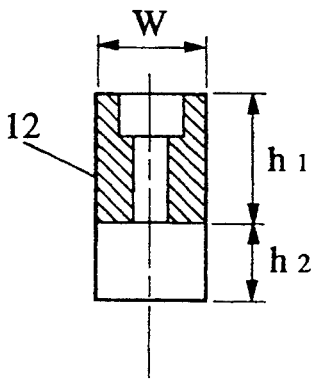
Figure 12:
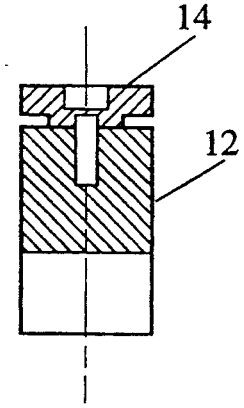
Figure 13:
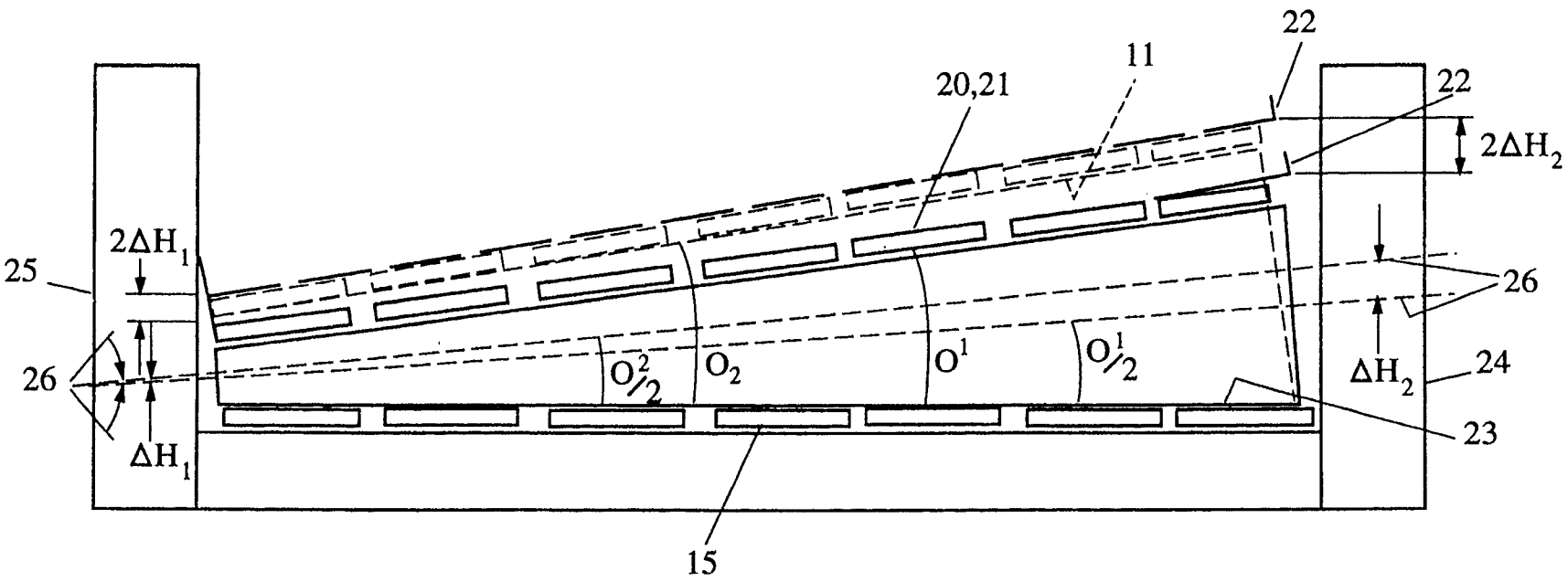
Figure 14:
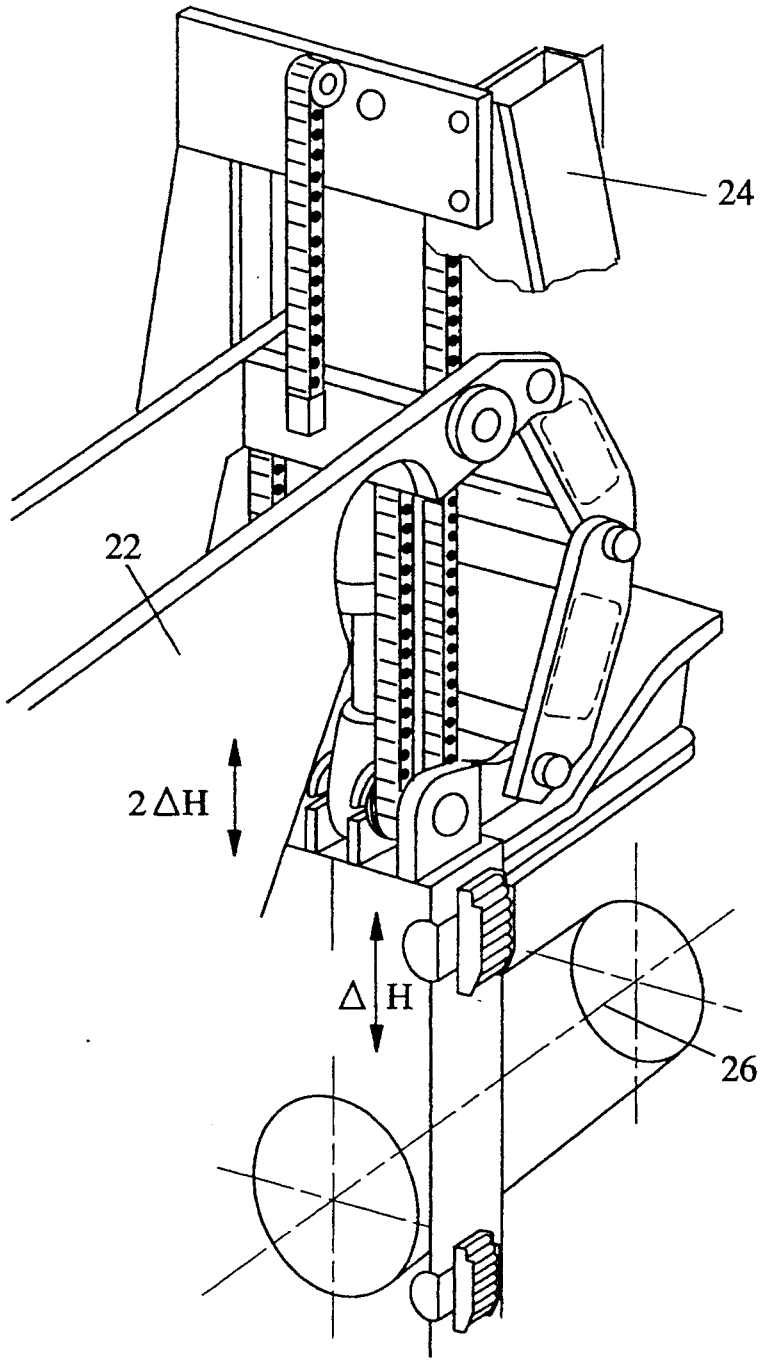
Figure 15:
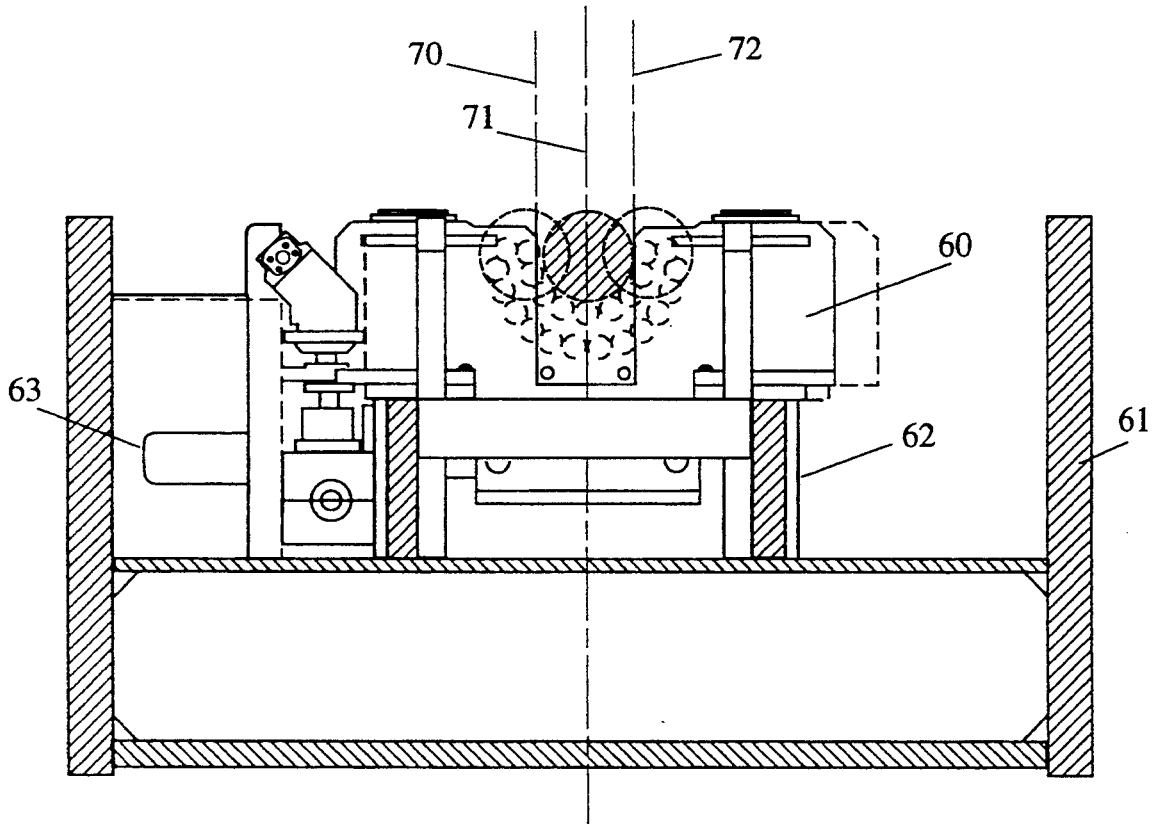

FIGS. 8*a*, 8*b* and 8*c* depict typical views of a single disc with and without spacer bar installed and a cross-section thereof;

FIG. 9 shows a typical spacer bar;

FIG. 10 is a perspective view of part of the mandrel and spacer bar construction;

FIG. 11 shows a cross-sectional view of the spacer bar;

FIG. 12 shows a cross-sectional view of a spacer bar with gripper plate attached;

FIG. 13 is a side elevation schematic view showing a tapered mandrel;

FIG. 14 shows one practical form of achieving desired proportional movement of the mandrel ends relative to the upper supporting beam;

FIG. 15 shows an end elevation of the simple roller support structure.

With reference to FIGS. 1 to 5, the mandrel is mounted fixed between centres adjacent to a loading table and a pressure roll 15.

The mandrel includes a gripper bar 14 for engagement with a plate 10.

It will be noted that the pressure roll 15 is laterally moved from the centre line 11*a* of the mandrel to apply pressure to the plate inserted into the gripper bar 14 but located so as not to foul the gripper bar. Application of pressure to the edge portion of the plate mounted in the gripper bar 14 and rotation of the mandrel 11 in an anti-clockwise manner will draw the plate around the mandrel and the plate will be forced to follow the curvature of the mandrel and form a hollow pipe section as shown schematically in FIGS. 4 and 5.

Figure 1:
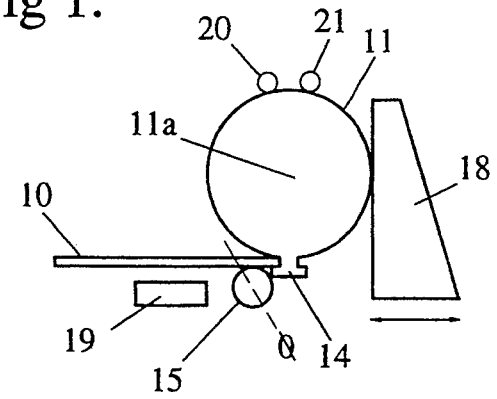
FIGS. 1 to 4 show schematic views of rolling steps of a plate on a mandrel which may be cylindrical or tapered utilizing a single pressure roll.
Figure 2:
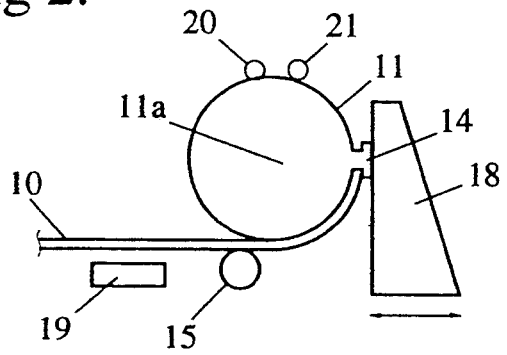
Figure 3:
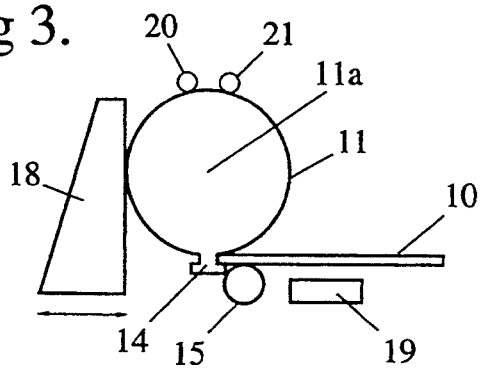
Figure 4:
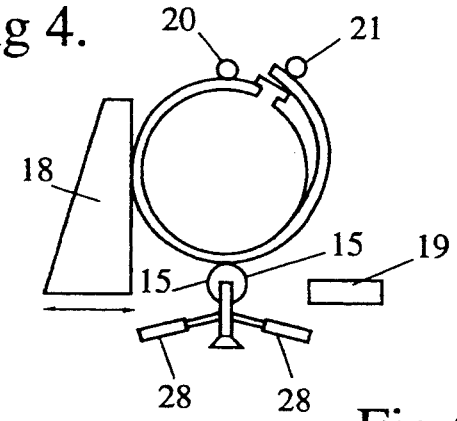

The roller 15 shown in FIG. 4 is mounted upon hydraulic actuating cylinders 16 acting to apply pressure against the surface of the plate on the mandrel and furthermore enabling lateral movement of the roll from one side of centre of the mandrel to the other depending upon the position of the gripper plate 14 as shown in FIGS. 1, 2 or 3.

Figure 5:
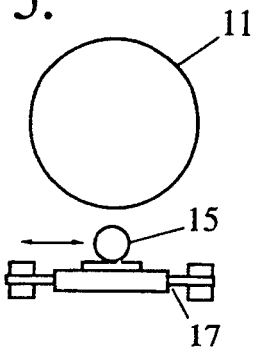
FIG. 5 is a second embodiment of the invention showing an alternative means of laterally moving the single pressure roll.
Figure 6:
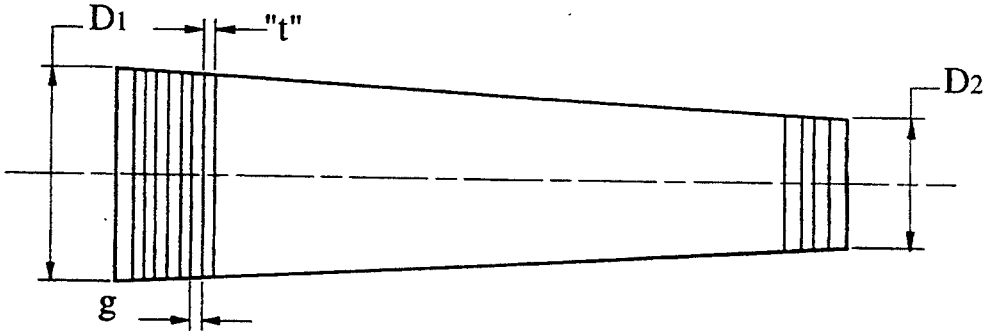
FIG. 6 is a schematic view of an arrangement of discs to form a variable taper mandrel.
Figure 7:
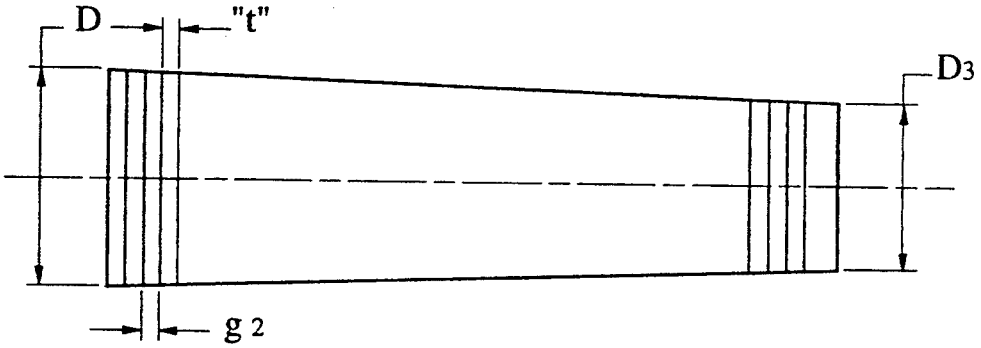
FIG. 7 is a schematic view of the arrangement of discs of FIG. 6 to form a slightly different taper.

With reference to FIG. 5, the single roller 15 is mounted for lateral movement relative to the mandrel by actuating screws 17.

The mandrel is movable in the vertical axis to allow lateral movement of the roller and thereby avoid contact with the gripper 14 during rotation of the mandrel and depending upon the location of the plate relative to the gripper.

Thus extremely high vertical forces can be applied to the mandrel and thence to the roller 15 through the centre of the mandrel with negligible lateral forces.

Thus mandrel deflection limiters 20, 21 may be positioned above the mandrel to apply deflection limiting forces against the mandrel to ensure more accurate tubular formation of the plate during a rolling operation. This is particularly important in the manufacture of small diameter tapered pipes having high wall thickness which require substantial forces during the forming operation. In these circumstances it is imperative that minimum lateral force is applied to the mandrel. It is therefore imperative that at critical times of the rolling operation the mandrel deflecting rolls 20, 21 and the single pressure roll 15 are movable to avoid fouling with the gripper plate when it is in the vicinity of the respective rollers.

Further descriptions of the mandrel deflecting apparatus have been made in my co-pending application filed coterminously with this application and having the Number PCT/AU90/00106, published Sep. 20, 1990, and the disclosures therein are thereby incorporated by cross-reference.

With reference to FIGS. 6 to 12. These figures show a series of schematic views of the construction of a tapered mandrel to enable the formation of a tapered pipe of varied diameter, taper angle, and wall thickness. The mandrel includes a shaft 10 upon which discs 11 are slidably mounted in a serial formation therealong in non-rotatable relationship.

The discs are mounted on the shaft 10 and spaced a fixed distance by a series of spacer bars 12 mounted about the periphery of said discs laminations and fixed therein by suitable screw fixing means.

FIG. 5 shows in greater detail the configuration of the spacer bar 12 and a typical screw fixing means 13 for securing the spacer bar to the discs.

It will be appreciated that the provision of screw fixing means on each and every disc lamination is not essential depending upon the forces that are likely to be encountered by the particular mandrel in a plate curving operation.

The spacer plate is adapted to be modified to accept a gripper plate 14 as shown in FIG. 12, whilst FIG. 11 shows a typical section of the spacer bar having an aperture, for receiving a fixing screw 13.

As previously mentioned, the spacer bar 12 may include teeth T which are formed on the bar at a constant spacing G. it will be appreciated that various spacer bars with different spacings G can be formed in order to be used to fix the disc like laminations at different spacings depending upon degree of taper of laminations on the mandrel as desired.

Thus it will be appreciated that the present invention enables the formation of mandrels having a different diameter and different taper angles according to the diameter of the disc like laminations and the spacing of the laminations on the spacer bars.

Having reference to FIGS. 13 and 14, the plate deflection limiters 20, 21, 18 and 19 are preferably mounted on a full length box girder 22 which is arranged above the mandrel 23 and is carried at each of its ends by the machine and the frames 24, 25.

As mentioned previously, the mandrel deflection limiters are described in greater detail in the co-pending application of similar date.

The ends of the girder 22 are movable relative to the end frames 24, 25 independently of each other in an upward or a downward direction.

This enables different tapered mandrels or cylindrical mandrels to be used selectively. The beam or girder 22 is conveniently mounted at each end by a chain drive mechanism that achieves the desirable proportional movement of the beam ends and the journal means 26 for the mandrel. As a result the vertical displacement $\Delta H$ of the mandrel drive centre line will cause a vertical displacement of 2 $\Delta H$ in the end of the beam 22, thus maintaining the correct interrelationship between movement of the mandrel and movement of the beam 22 during forming and during change over from one size mandrel to another.

With reference to FIG. 15 this shows the simple roller in three alternate positions depending upon the location of the gripper and the different stages of the forming process.

The left hand position 70 of roller 15 corresponds to the process stage illustrated in FIG. 1 of the drawings during formation of the first part of the semi-circle.

The right hand position 72 of roller 15 corresponds to the process stage illustrated in FIG. 3 to form the initial stage of the second semi-circle of the plate forming process.

The central position 71 is used to complete the formation of the curved plate into a substantially tubular state. In this position great forces are required to be generated between the mandrel and the plate being formed and it is essential in this mode that the force applied is symmetrical to the centre of the mandrel.

The forces required when the roller is in position 70 and 72 are relatively small and therefore the lateral forces are not excessive at this stage.

In previous applications using a pair of pressure rollers the operation was similar to the operation of the single roller construction during the relatively low load stages as mentioned above.

It is during the final forming high load stage that a significant and important feature of the single roller operation is to be observed when the roller is in position 71 shown in FIG. 15.

Whereas in previous case with two pressure rollers it was necessary to lower the level of the mandrel to exert the large force necessary to generate friction between the mandrel and the plate it is not necessary to lower the mandrel to generate the required friction when the single roller is used in position 71.

This feature is found to be essential in the forming of long products of small diameter, as excessive deflections can occur when lowering the mandrel between two pressure rollers. These are practically eliminated and readily corrected when the single pressure roller is used.

A further essential feature is that a wide variety of steel plates can be formed by setting the eccentricity of the single pressure roll.

Thus the single roll allows full line contact with a cylindrical or tapered mandrel with uniformly distributed load.

A relatively large roller can be used with good support.

The mandrel is maintained practically at constant height throughout the forming operation.

I claim:

1. A plate rolling apparatus comprising a rotatable mandrel mounted in a frame, a gripper rib on the mandrel extending axially therealong adapted to grip the edge of a plate to be curved around the mandrel when the mandrel is rotated, a single pressure roller mounted beneath the mandrel and adapted to contact the surface of the plate and apply a squeezing force to the plate and the mandrel, the pressure roller being laterally movable sideways relative to the center line of the mandrel depending upon the location of the gripper in the region of the roller during a plate rolling operation, so as not to foul the gripper yet applying said squeezing force to said plate, wherein the single roller applies pressure normal to said plate thereby avoiding undesirable lateral forces on the mandrel and is adjustable to be in direct alignment with the mandrel center at least when the gripper is not in the vicinity, and when large forces are required to be applied between the mandrel and the plate.

2. A plate rolling apparatus as claimed in claim 1 comprising deflection limiting means mounted on the frame adapted to engage the mandrel and plate during a rolling operation to limit at least horizontal deflection of the mandrel that may occur during rolling of the plate.

3. A plate rolling apparatus as claimed in claim 1 wherein the mandrel is suitable for the formation of a hollow tapered pipe said mandrel including a series of disc like laminations mounted in serial formation, each lamination having a diameter of slightly less than an adjacent lamination on one side and a diameter slightly larger than a lamination on the other side so that the formation of laminations taken together form a substantial frustoconical or conical body, a framework upon which said laminations are mounted so that relative movement of the laminations and the framework is resisted, said mandrel being adapted to form the plate into a tapered curved section upon rotation of the mandrel and to ultimately form a tapered pipe after curving both opposite edge portions of said plate.

4. A plate bending machine as claimed in claim 3 wherein the disc-like laminations are non-rotatably mounted upon a shaft which extends for the full length of said mandrel and said laminations are spaced part a predetermined distance from one another so as to form a desired taper angle.

5. A plate rolling apparatus as claimed in claim 1, said frame comprising: a base section, upstanding opposed end sections and an upper movable support member, said upstanding opposed end sections including journal means for support of said mandrel, at least one of said journal means being movable in an upward or downward direction, lower roller means mounted from said base section having a plate engagement zone parallel to an adjacent lower surface of the mandrel and adapted to apply pressure to a metal plate interposed between said mandrel and said lower roller means, and upper roller means mounted on said movable support member having a plate engagement zone parallel to an adjacent upper surface of said mandrel, said machine being characterized by means for moving said support member in response to movement of the journal means whereby the support member and adjacent said movable journal means is moved upwardly or downwardly by a distance being twice that of the movement of the movable journal means.

6. A plate rolling apparatus as claimed in claim 5, wherein both ends of the mandrel are movable with equivalent movement of the ends of the support member so that varied diameters and angles of taper of mandrels can be accommodated.

7. A plate rolling apparatus as claimed in claim 2 wherein the single roller is laterally movable sideways relative to the center line of the mandrel to avoid fouling the gripper.

8. A plate rolling apparatus as claimed in claim 2, wherein the mandrel is suitable for the formation of a hollow tapered pipe said mandrel including a series of disc-like laminations mounted in serial formation, each lamination having a diameter of slightly less than an adjacent lamination on one side and a diameter slightly larger than a lamination on the other side so that the formation of laminations taken together form a substantial frustoconical or conical body, a framework on which said laminations are mounted so that relative movement of the laminations and the framework is resisted, said mandrel being adapted to form the plate into a tapered curved section upon rotation of the mandrel and to ultimately form a tapered pipe after curving both opposite edge portions of said plate.

9. A plate bending machine as claimed in claim 8, wherein the disclike laminations are non-rotatably mounted upon a shaft which extends for the full length of said mandrel and said laminations are spaced apart a predetermined distance from one another so as to form a desired taper angle.

10. A plate rolling apparatus as claimed in claim 1 wherein the mandrel is suitable for the formation of a hollow tapered pipe said mandrel including a series of disc-like laminations mounted in serial formation, each lamination having a diameter of slightly less than an adjacent lamination on one side and a diameter slightly larger than a lamination on the other side so that the formation of laminations taken together form a substantial frustoconical or conical body, a framework on which said laminations are mounted so that relative movement of the laminations and the framework is resisted, said mandrel being adapted to form the plate into a tapered curved section upon rotation of the mandrel and to ultimately form a tapered pipe after curving both opposite edge portions of said plate.

11. A plate bending machine as claimed in claim 10, wherein the disc-like laminations are non-rotatably mounted upon a shaft which extends for the full length of the mandrel, said laminations spaced apart a predetermined distance from one another so as to form a desired taper angle.

12. A plate rolling apparatus comprising a rotatable mandrel mounted in a frame, a gripper rib on the mandrel extending axially therealong adapted to grip the edge of a plate to be curved around the mandrel when the mandrel is rotated, a single pressure roller mounted beneath the mandrel and adapted to contact the surface of the plate and apply an upward force against the plate, the pressure roll being laterally movable sideways relative to the center line of the mandrel, so as not to foul the gripper during plate engagement yet apply substantial squeezing force to said plate during final stage of rolling, wherein the single roller applies pressure normal to said plate thereby avoiding undesirable lateral forces on the mandrel and is adjustable to be in direct alignment with the mandrel center when the gripper is not in the vicinity.

* * * * *